US008118079B2

(12) United States Patent
Hanna et al.

(10) Patent No.: US 8,118,079 B2
(45) Date of Patent: Feb. 21, 2012

(54) CASTING NOISE-DAMPED, VENTED BRAKE ROTORS WITH EMBEDDED INSERTS

(75) Inventors: Michael D. Hanna, West Bloomfield, MI (US); Mohan Sundar, Troy, MI (US); Andrew Schertzer, St. Catharines (CA)

(73) Assignee: GM Global Technology Operations LLC, Detroit, MI (US)

( * ) Notice: Subject to any disclaimer, the term of this patent is extended or adjusted under 35 U.S.C. 154(b) by 687 days.

(21) Appl. No.: 12/183,180

(22) Filed: Jul. 31, 2008

(65) Prior Publication Data

US 2009/0044923 A1 Feb. 19, 2009

Related U.S. Application Data

(60) Provisional application No. 60/956,422, filed on Aug. 17, 2007.

(51) Int. Cl.
*B22D 19/00* (2006.01)

(52) U.S. Cl. ..... 164/98; 164/100; 164/110; 164/112; 164/137

(58) Field of Classification Search ..... 164/75, 164/98, 100, 108, 112, 137, 110
See application file for complete search history.

(56) References Cited

U.S. PATENT DOCUMENTS

| | | | |
|---|---|---|---|
| 974,024 | A | 10/1910 | Carter |
| 1,484,421 | A | 2/1924 | Thompson |
| 1,989,211 | A | 1/1935 | Norton |
| 2,012,838 | A | 8/1935 | Tilden |
| 2,026,878 | A | 1/1936 | Farr |
| 2,288,438 | A | 6/1942 | Dach |
| 2,603,316 | A | 7/1952 | Pierce |
| 2,978,793 | A | 4/1961 | Lamson et al. |
| 3,085,391 | A | 4/1963 | Hatfield et al. |
| 3,127,959 | A | 4/1964 | Wengrowski |
| 3,147,828 | A | 9/1964 | Hunsaker |
| 3,292,746 | A | 12/1966 | Robinette |
| 3,378,115 | A | 4/1968 | Stephens, III |
| 3,425,523 | A | 2/1969 | Robinette |
| 3,509,973 | A | 5/1970 | Kimata |
| 3,575,270 | A | 4/1971 | Wagenfuhrer et al. |

(Continued)

FOREIGN PATENT DOCUMENTS

| | | | |
|---|---|---|---|
| CH | 428319 | A | 1/1967 |

(Continued)

OTHER PUBLICATIONS

International Search Report dated Apr. 2, 2007 for International Application No. PCT US06/29687, Publication No. WO 2007/040768; GM Global Technology Operations, Inc.

(Continued)

*Primary Examiner* — Jessica L Ward
*Assistant Examiner* — Kevin E Yoon
(74) *Attorney, Agent, or Firm* — Reising Ethington P.C.

(57) ABSTRACT

An assembly of like two rib cores enclosing a splitter core are used to carry two or four sound damping inserts for sand mold casting of a pair of vented and damped brake rotors. Sand mold bodies are configured to define outboard surfaces of hub and rotor surfaces of the cast brake rotors. The three-piece core assembly is shaped to define the complex inner surfaces in casting of vented rotor bodies carrying one or two annular sound damping inserts.

10 Claims, 4 Drawing Sheets

U.S. PATENT DOCUMENTS 3,774,472 A 11/1973 Mitchell
3,841,448 A 10/1974 Norton, Jr.
3,975,894 A 8/1976 Suzuki
4,049,085 A 9/1977 Blunier
4,072,219 A 2/1978 Hahm et al.
4,195,713 A 4/1980 Hagbjer et al.
4,250,950 A 2/1981 Buxmann et al.
4,278,153 A 7/1981 Venkatu
4,338,758 A 7/1982 Hagbjer
4,379,501 A 4/1983 Hagiwara et al.
4,475,634 A 10/1984 Flaim et al.
4,523,666 A 6/1985 Murray
4,529,079 A 7/1985 Albertson
4,905,299 A 2/1990 Ferraiuolo et al.
5,004,078 A 4/1991 Oono et al.
5,025,547 A 6/1991 Sheu et al.
5,083,643 A 1/1992 Hummel et al.
5,115,891 A 5/1992 Raitzer et al.
5,139,117 A 8/1992 Melinat
5,143,184 A 9/1992 Snyder et al.
5,183,632 A 2/1993 Kluchi et al.
5,184,662 A 2/1993 Quick et al.
5,184,663 A * 2/1993 Oono et al. ..... 164/98
5,259,486 A 11/1993 Deane
5,310,025 A 5/1994 Anderson
5,416,962 A 5/1995 Passarella
5,417,313 A 5/1995 Matsuzaki et al.
5,509,510 A 4/1996 Ihm
5,530,213 A 6/1996 Hartsock et al.
5,582,231 A 12/1996 Siak et al.
5,620,042 A 4/1997 Ihm
5,660,251 A 8/1997 Nishizawa et al.
5,789,066 A 8/1998 DeMare et al.
5,819,882 A 10/1998 Reynolds et al.
5,855,257 A 1/1999 Wickert et al.
5,862,892 A 1/1999 Conley
5,878,843 A 3/1999 Saum
5,927,447 A 7/1999 Dickerson
5,965,249 A 10/1999 Sutton et al.
6,047,794 A 4/2000 Nishizawa
6,073,735 A 6/2000 Botsch et al.
6,112,865 A 9/2000 Wickert et al.
6,206,150 B1 3/2001 Hill
6,216,827 B1 4/2001 Ichiba et al.
6,223,866 B1 5/2001 Giacomazza
6,231,456 B1 5/2001 Rennie et al.
6,241,055 B1 6/2001 Daudi
6,241,056 B1 6/2001 Cullen et al.
6,283,258 B1 9/2001 Chen et al.
6,302,246 B1 10/2001 Naumann et al.
6,357,557 B1 3/2002 DiPonio
6,405,839 B1 6/2002 Ballinger et al.
6,465,110 B1 10/2002 Boss et al.
6,481,545 B1 11/2002 Yano et al.
6,505,716 B1 1/2003 Daudi et al.
6,507,716 B2 1/2003 Nomura et al.
6,543,518 B1 4/2003 Bend et al.
6,648,055 B1 11/2003 Haug et al.
6,799,664 B1 10/2004 Connolly
6,880,681 B2 4/2005 Koizumi et al.
6,890,218 B2 5/2005 Patwardhan et al.
6,899,158 B2 5/2005 Matuura et al.
6,932,917 B2 8/2005 Golden et al.
6,945,309 B2 9/2005 Frait et al.
7,066,235 B2 6/2006 Huang
7,112,749 B2 9/2006 DiPaola et al.
7,178,795 B2 2/2007 Huprikar et al.
7,293,755 B2 11/2007 Miyahara et al.
7,594,568 B2 9/2009 Hanna et al.
7,604,098 B2 10/2009 Dessouki et al.
7,644,750 B2 1/2010 Schroth et al.
7,775,332 B2 8/2010 Hanna et al.
7,836,938 B2 11/2010 Agarwal et al.
2002/0084156 A1 7/2002 Ballinger et al.
2002/0104721 A1 8/2002 Schaus et al.
2003/0037999 A1 2/2003 Tanaka et al.
2003/0127297 A1 7/2003 Smith et al.
2003/0141154 A1 7/2003 Rancourt et al.
2003/0213658 A1 11/2003 Baba
2004/0031581 A1 2/2004 Herreid et al.
2004/0045692 A1 3/2004 Redemske
2004/0074712 A1 4/2004 Quaglia et al.
2004/0084260 A1 5/2004 Hoyte et al.
2004/0242363 A1 12/2004 Kohno et al.
2005/0011628 A1 1/2005 Frait et al.
2005/0150222 A1 7/2005 Kalish et al.
2005/0183909 A1 8/2005 Rau, III et al.
2005/0193976 A1 9/2005 Suzuki et al.
2006/0076200 A1 4/2006 Dessouki et al.
2006/0243547 A1 11/2006 Keller
2007/0039710 A1 2/2007 Newcomb
2007/0056815 A1 3/2007 Hanna et al.
2007/0062664 A1 3/2007 Schroth et al.
2007/0062768 A1 3/2007 Hanna et al.
2007/0142149 A1 6/2007 Kleber
2007/0166425 A1 7/2007 Utsugi
2007/0235270 A1 10/2007 Miskinis et al.
2007/0298275 A1 12/2007 Carter et al.
2008/0099289 A1 5/2008 Hanna et al.
2008/0185249 A1 8/2008 Schroth et al.
2009/0032569 A1 2/2009 Sachdev et al.
2009/0107787 A1 4/2009 Walker et al.

FOREIGN PATENT DOCUMENTS

CN 2005/10113784.X 10/2005
CN 20051113784 A 10/2005
CN 1757948 A 4/2006
CN 2863313 Y 1/2007
DE 24 46 938 4/1976
DE 2446938 A1 4/1976
DE 25 37 038 3/1977
DE 2537038 A1 3/1977
DE 19649919 A1 6/1998
DE 199 48 009 3/2001
DE 19948009 C1 3/2001
DE 60000008 T2 3/2002
DE 101 41 698 3/2003
DE 10141698 A1 3/2003
DE 102005048258.9 10/2005
DE 102005048258 A1 4/2006
DE 60116780 T2 11/2006
EP 0 205 713 12/1986
EP 0205713 A1 12/1986
GB 1230 274 4/1971
GB 1230274 4/1971
GB 2328952 3/1999
JP 57154533 9/1982
JP 57154533 A 9/1982
JP 1126434 U1 8/1989
JP 05-104567 4/1993
JP 11342461 A 12/1999
JP 2001512763 T 8/2001
JP 2003214465 A 7/2003
JP 2004011841 A 1/2004
KR 20010049837 A 6/2001
WO 9823877 A1 6/1998
WO WO 98/23877 6/1998
WO 0136836 A1 5/2001
WO WO 01/36836 5/2001
WO 2007035206 A2 3/2007

OTHER PUBLICATIONS

Omar Dessouki, George Drake, Brent Lowe, Wen Kuei Chang, General Motors Corp: Disc Brake Squeal: Diagnosis & Prevention. 03NVC-224; Society of Automotive Engineer, Inc. 2002.

Z. Wu, C. Richter, L. Menon, A Study of Anodization Process During Pore Formation in Nanoporous Alumina Templates, Journal of the Electrochemical Society, vol. 154, 2007.

W.-J. Lee, M. Alhoshan, W.H. Smyrl, Titanium Dioxide Nanotube Arrays Fabricated by Anodizing Processes, Journal of the Electrochemical Society, vol. 153, 2006, pp. B499-505.

I.V. Sieber, P. Schmuki, Porous Tantalum Oxide Prepared by Electrochemical Anodic Oxidation, Journal of the Electrochemical Society, vol. 152, 2005, pp. C639-C644.

H. Tanaka, A. Shimada, A. Kinoshita, In situ Measurement of the Diameter of Nanopores in Silicon During Anodization in Hydrofluoric Acid Solution, Journal of the Electrochemic.
L.G. Hector, Jr., S. Sheu, Focused Energy Beam Work Roll Surface Texturing Science and Technology, Journal of Materials Processing & Manufacturing Science, vol. 2, Jul. 1993.
P.N. Anyalebechi, Ungrooved Mold Surface Topography Effects on Cast Subsurface Microstructure, Materials Processing Fundamentals, TMS 2007, pp. 49-62.
F. Yigit, Critical Wavelengths for Gap Nucleation in Solidification—Part 1: Theoretical Methodology, Journal of Applied Mechanics, vol. 67, Mar. 2000, pp. 66-76.
P.N. Anyalebechi, Undulatory Solid Shell Growth of Aluminum Alloy 3003 as a Function of the Wavelength of a Grooved Mold Surface Topography, TMS 2007, pp. 31-47.
Dessouki et al., U.S. Appl. No. 10/961,813, Coulumb friction damped disc brake rotors, filed Oct. 8, 2004.
Hanna et al., U.S. Appl. No. 11/475,756, Bi-metal disc brake rotor and method of manufacturing, filed Jun. 27, 2006.
Schroth et al., U.S. Appl. No. 11/475,759, Method of casting components with inserts for noise reduction, filed Jun. 27, 2006.
Schroth et al., U.S. Appl. No. 12/025,967, Damped products and methods of making and using the same, filed Feb. 5, 2008.
Hanna et al., U.S. Appl. No. 11/440,916, Bi-metal disc brake rotor and method of manufacture, filed May 25, 2006.
Hanna et al., U.S. Appl. No. 11/554,234, Coulomb damped disc brake rotor and method of manufacturing, filed Oct. 30, 2006.
Walker et al., U.S. Appl. No. 11/926,798, Inserts with holes for damped products and methods of making and using the same, filed Oct. 29, 2007.
Hanna et al., U.S. Appl. No. 11/832,401, Damped product with insert and method of making the same, filed Aug. 1, 2007.
Kleber, et al., U.S. Appl. No. 11/848,732, Cast-in-place torsion joint, filed Aug. 31, 2007.
Hanna et al., U.S. Appl. No. 11/780,679, Method of manufacturing a damped part, filed Jul. 20, 2007.
Aase et al., U.S. Appl. No. 11/969,259, Method of forming casting with frictional damping insert, filed Jan. 4, 2008.
Hanna et al., U.S. Appl. No. 12/165,729, Method for securing an insert in the manufacture of a damped part, filed Jul. 1, 2008.
Hanna et al., U.S. Appl. No. 12/165,731, Product with metallic foam and method of manufacturing the same, filed Jul. 1, 2008.
Agarwal et al., U.S. Appl. No. 11/860,049, Insert with tabs and damped products and methods of making the same, filed Sep. 24, 2007.
Hanna et al., U.S. Appl. No. 12/174,163, Damped part, filed Jul. 16, 2008.
Hanna et al., U.S. Appl. No. 12/174,223, Method of casting damped part with insert, filed Jul. 16, 2008.
Hanna et al., U.S. Appl. No. 12/183,104, Low mass multi-piece sound damped article, filed Jul. 31, 2008.
Golden et al., U.S. Appl. No. 12/105,411, Insert with filler to dampen vibrating components, filed Apr. 18, 2008.
Hanna et al., U.S. Appl. No. 11/440,893, Rotor assembly and method, filed May 25, 2006.
Carter, U.S. Appl. No. 11/680,179, Damped automotive components with cast in place inserts and method of making same, filed Feb. 28, 2007.
Ulicny et al., U.S. Appl. No. 12/105,438, Filler material to dampen vibrating components, filed Apr. 18, 2008.
Hanna et al., U.S. Appl. No. 12/272,164, Surface configurations for damping inserts, filed Nov. 17, 2008.
Hanna et al, U.S. Appl. No. 12/145,169, Damped product with an insert having a layer including graphite thereon and methods of making and using the same, filed Jun. 24, 2008.
Lowe et al., U.S. Appl. No. 12/174,320, Damped part with insert, filed Jul. 16, 2008.
Xia, U.S. Appl. No. 12/858,596, Lightweight brake rotor and components with composite materials, filed Sep. 20, 2007.
Dessouki et al., U.S. Appl. No. 12/178,872, Friction damped brake drum, filed Jul. 24, 2008.
Sachdev et al., U.S. Appl. No. 11/832,356, Friction welding method and products made using the same, filed Aug. 1, 2007.
Chinese First Office Action; CN200510113784.X; Dated May 18, 2007; 19 pages.
Chinese Second Office Action; CN200510113784.X; Dated Feb. 15, 2008; 13 pages.
German Examination Report; DE102005048258.9-12; Dated Oct. 22, 2007; 8 pages.
Gerdemann, Steven J,; Titanium Process Technologies; Advanced Materials & Processes, Jul. 2001, pp. 41-43.
Mahoney, M. W. & Lynch S. P.; Friction-Stir Processing; 15 pages.
MPIF: All You Need to Know about Powder Metallurgy; http://www.mpif.org/IntroPM/intropm/asp?linkid=1; 8 pages.
Powder Metallurgy—Wikipedia article; http://en.wikipedia.org/wiki/Powder_metallurgy; 5 pages.
Sintering—Wikipedia article; http://en.wikipedia.org/wiki/Sintering; 2 pages.
Magnetorheological fluid- Wikipedia article; http:en/wikipedia.org/wiki/Magnetorheological_fluid.
PCT/US2008/087354 Written Opinion and Search Report; Date of Mailing: Aug. 3, 2009; 9 pages.
PCT/US2009/039839 Written Opinion and Search Report; Date of Mailing: Nov. 24, 2009; 7 pages.
PCT/US2009/048424 Written Opinion and Search Report; Date of Mailing; Dec. 28, 2009; 7 pages.
U.S. Appl. No. 12/328,989, filed Dec. 5, 2008; First Named Inventor: Patrick J. Monsere.
U.S. Appl. No. 12/420,259, filed Apr. 8, 2009; First Named Inventor: Michael D. Hanna.
U.S. Appl. No. 12/434,057, filed May 1, 2009; First Named Inventor: Chongmin Kim.
U.S. Appl. No. 12/436,830, filed May 7, 2009; First Named Inventor: James G. Schroth.
U.S. Appl. No. 12/489,901, filed Jun. 23, 2009; First Named Inventor: Michael D. Hanna.
U.S. Appl. No. 12/885,813, filed Sep. 20, 2010; first Named Inventor: Michael D. Hanna.

* cited by examiner

CASTING NOISE-DAMPED, VENTED BRAKE ROTORS WITH EMBEDDED INSERTS

This application claims priority based on provisional application 60/956,422, titled "Casting Noise-Damped, Vented Brake Rotors with Embedded Inserts," filed Aug. 17, 2007 and which is incorporated herein by reference.

TECHNICAL FIELD

This specification pertains to the casting of brake rotors with cooling vents and embedded inserts. More specifically, this specification pertains to an arrangement of cores that enable sand casting of pairs of such brake members.

BACKGROUND OF THE INVENTION

There is interest in the manufacture of brake rotors that are vented for cooling and contain sound damping inserts. Such rotors are often used for braking of vehicle wheels.

In many embodiments such brake rotors have a round hub for attachment to a vehicle wheel and a radially outwardly extending rotor portion attached to the central hub. In vehicle operation the hub and rotor rotate about a central axis coincident with the rotational axis of the wheel to which they are attached. The rotor is shaped like an annular disk with an annular body, extending radially from the hub, that has two flat, parallel, annular faces (sometimes called "cheeks") and a circumferential end surface. One cheek of the rotor is on the hub side of the brake rotor structure and the other cheek is the rotor surface on the opposite side of the rotor body. In a braking operation, pads of friction material are pressed tightly against the then rotating cheeks of the rotor to stop rotation of the rotor and attached wheel. Such braking friction produces heat in the rotor and mechanical vibrations. Sometimes the vibrations result in high frequency noise (typically brake squeal).

In some rotor designs the rotor body is solid, but in many rotors the body portion contains several generally radially extending, transverse vanes defining intervening air ducts for air cooling of frictional heat produced in the rotor body during braking. The vanes are formed generally centrally of the rotor body to leave one or two outboard durable body thicknesses for braking pressure applied against the cheek surfaces. In order to suppress brake squeal it is desired to provide an annular, typically flat insert piece in one or both rotor body portions outboard of the vanes. It is also desired to cast rotor material around the noise damping insert body so as to form suitable noise damping (typically by coulomb friction damping) surface regions between contiguous faces of the enclosing cast rotor metal and the insert material.

By way of example and as an illustration, annular insert plates may be steel stampings, with or without a coating of particulate material, for frictional contact with the engaging inner face surfaces of the cast rotor material. And the rotor and hub may be formed of a suitable cast iron composition.

It has been a challenge to devise a practical and economical method of manufacturing such noise damped, vented brake rotors with vanes for cooling and inserts for vibration damping. This specification provides an assembly of cores, typically three specially designed and complementary resin-bonded sand cores, that enables sand casting of pairs of such rotors. An assembly of cores is also provided that enables sand casting of more than two rotors at the same time.

SUMMARY OF THE INVENTION

In accordance with an embodiment of this invention, a sand mold casting process is provided for casting of a pair (or multiple pairs) of vented brake rotors with inserts embedded in the vane-containing rotor bodies of the castings. For purposes of description of a brake rotor and the disclosed casting process, it is assumed that when a brake rotor is attached to a vehicle corner, the hub portion of the brake rotor lies outwardly (outboard) on the rotational axis of the wheel and the annular rotor body lies inboard of the hub along the rotational axis of the wheel. Each brake rotor has internal vanes between outboard and inboard rotor body portions. The outboard and inboard body portions have outer faces that will be engaged by brake pads in vehicle operation and inner faces that merge with the air passage defining vanes. An insert for coulomb friction damping may be enclosed within either or both of the rotor body portions. In the following illustration, a particle coated, steel insert is enclosed within the inboard rotor body.

In this illustrative embodiment, a multiple-part (typically two-part) sand mold is prepared with complementary facing (e.g., cope and drag) mold bodies each having casting cavity surfaces that define the outboard (hub-side) surfaces of two facing, side-by-side brake rotors. The mold bodies also define the outboard face of the hub and the outboard rotor cheek faces of the two rotors. A three-part sand core assembly is constructed to lay between the facing mold cavity surfaces and to define the inboard side of each rotor. The sand mold may be arranged in a horizontal or vertical attitude for metal casting.

Two of the sand cores may be identical. They may be shaped to be assembled face-to-face, and termed "rib-cores" in this specification for convenient reference. Each assembled rib core is shaped to define the following inboard surfaces on one of the pair of cast rotors: the inboard face of the rotor hub, the inner face of the outboard rotor body, the vanes for venting the rotor body (hence the "rib core"), the inner face of the inboard rotor body, and tab supports for a cast-in-place damping insert. The third sand core is of annular shape and further shaped to lie between radially outer portions of the facing rib-cores. This core is aptly described as a "splitter core" and it defines outer cheek faces of the inboard rotor bodies. The cores are further shaped to support a sound damping insert between each rib core and an interposed splitter core.

In the assembly of the cores for casting, a sound damping insert is placed on each side of the splitter core and inside the facing and sandwiching rib cores. The assembled three core bodies and inserts may be clamped together and positioned between the facing mold bodies. The mold pieces may be provided and arranged with molten metal flow passages for horizontal or vertical attitude of the parts to be cast. The assembly permits simultaneous casting of one or more pairs of similar or identical insert-containing, noise damped, vented brake rotors.

Other objects and advantages of this invention will be apparent from a description of illustrative preferred embodiments which follows with reference to the following drawing figures.

DESCRIPTION OF PREFERRED EMBODIMENTS

In this illustrative embodiment of the invention a representative brake rotor is shown. A method is disclosed for simultaneously casting one or more pairs of such rotors in a sand mold using a set of three resin bonded sand cores for each pair of rotors.

Figure 1:
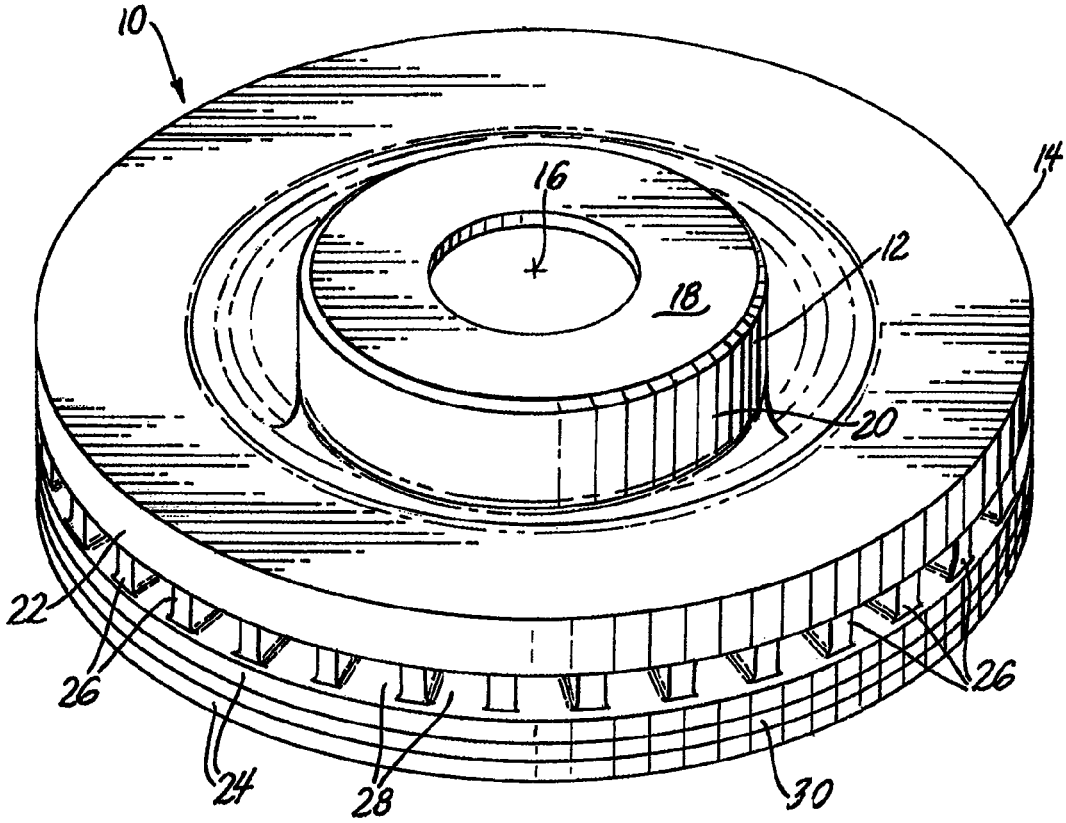
FIG. 1 is an oblique view of a sand cast brake rotor with a hub and rotor body with vanes for flow of cooling air. The rotor body portion of the casting encloses an insert for columbic frictional damping of vibrations in the rotor during vehicle braking.

Referring to FIG. 1, brake rotor 10 is a braking member adapted to be mounted to a vehicle wheel, not shown. Brake rotor 10 is mounted to a wheel of, for example, an automotive vehicle on the inboard side of the wheel (with respect to the assembled vehicle) for stopping the rotation of the wheel in operation of the vehicle. A brake caliper device presses friction pads against the sides of the rotor to stop its rotation. Four such brake rotors 10 may be used on a vehicle, one with each of the four wheels. Brake rotor 10 is round and shaped for rotation about a central axis through center 16. The rotational axis of brake rotor 10 is coincident with the rotational axis of the wheel to which it is attached.

Brake rotor 10 comprises a hub 12 and a rotor 14. Hub 12 comprises a radial hub surface 18 providing an attachment interface to a vehicle wheel, and an axial hub surface 20 that is connected at one side to rotor 14. Typically, the brake rotor is carried on wheel bearing studs and the wheel is also carried on the bearing studs. Hub 12 is typically bolted to the wheel although bolt holes are not illustrated in FIG. 1. In an assembled vehicle wheel, radial surface 18 of hub 12 is the outermost portion (the outboard side) of brake rotor 10.

Figure 2:
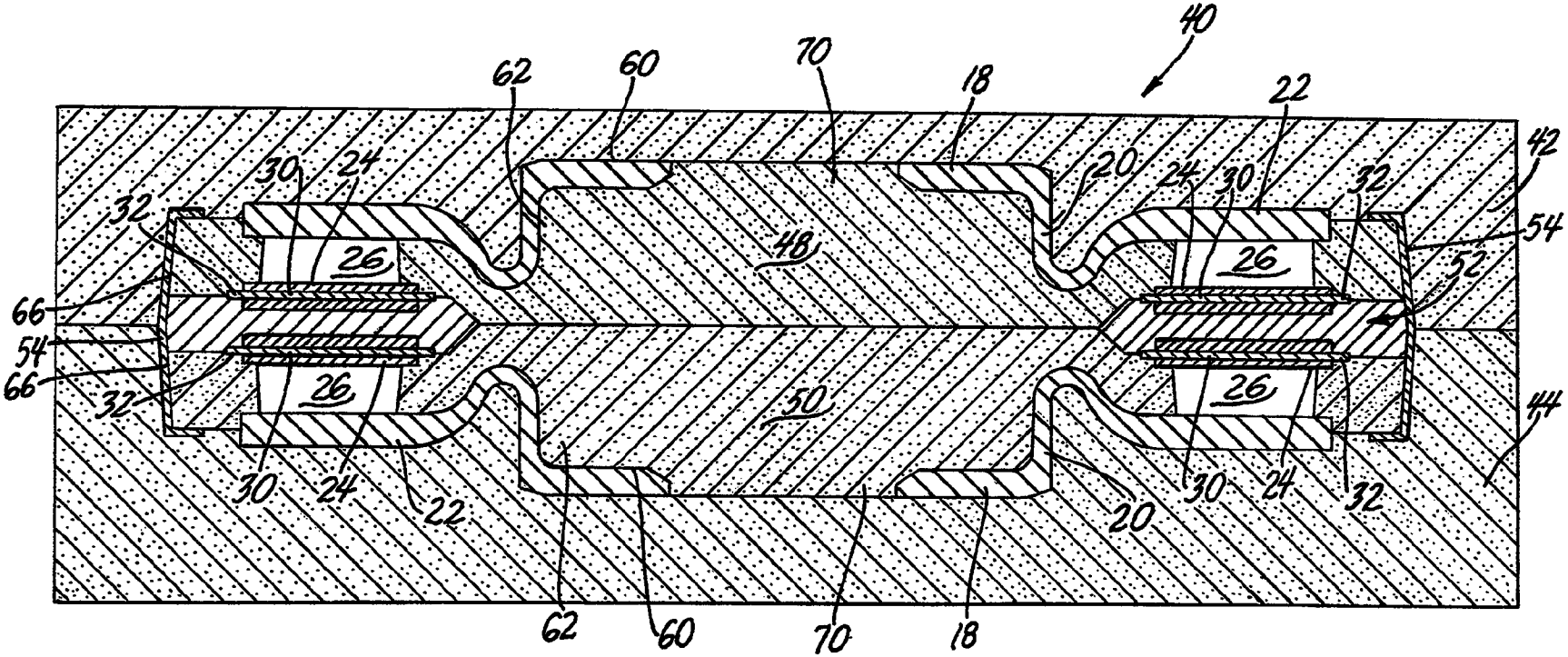
FIG. 2 is a cross-sectional view of a two-part sand mold with an assembly of three sand cores for casting a pair of brake rotors, each with a vibration damping insert, and vanes for cooling.

Rotor 14 comprises an outboard annular rotor body 22 and an inboard annular rotor body 24 that sandwich several radial vanes 26. Radial vanes 26 may have a curved (or partially spiral) configuration. When brake rotor 10 is rotating with the vehicle wheel to which it is attached, air is pumped by centrifugal force from the radial interior of rotor bodies 22, 24 through air flow spaces 28 between and bounded by radial vanes 26, outboard rotor body 22, and inboard rotor body 24. Brake rotor 10 also comprises one or more inserts for sound damping. In vane-containing brake rotor 10, such an insert may be located in one of the rotor bodies 22, 24, or both. In this embodiment of the disclosure, an annular sound damping insert 30 is enclosed within inboard rotor body 24. Annular sound damping insert 30 has parallel, radially extending side faces for columbic frictional engagement with the surrounding cast metal of inboard rotor body 24. Sound damping insert 30 also comprises a plurality of radial tabs 32 distributed uniformly around its outer circumferential surface for use in the casting of rotor metal as will be described. In FIG. 2, annular sound damping inserts 30 are illustrated as extending across the full radial dimension of inboard rotor body 24 but a smaller insert may extend only part way across a rotor body.

FIG. 2 is a cross-sectional view of a sand mold and coring combination 40 for casting a pair of like (or identical) brake rotors 10 at the same time. Sand mold and coring combination 40 is illustrated in a horizontal casting mode but may, with minor adaptation for flow of cast molten metal, be employed in a vertical casting mode. In this illustrative embodiment, sound damping insert 30 is formed of stamped steel (with a thin coating of refractory particles) and the balance of brake rotor 10 is formed as a wear resistant cast iron. In other embodiments, the insert 30 may be formed of, for example but not limited to, aluminum, stainless steel, cast iron, any of a variety of other alloys, or metal matrix composite. In other embodiments, the coating over the sound damping insert 30 may include, for example but not limited to, particles, flakes, or fibers including silica, alumina, graphite with clay, silicon carbide, silicon nitride, cordierite (magnesium-iron-aluminum silicate), mullite (aluminum silicate), zirconia (zirconium oxide), phyllosilicates, or other high-temperature-resistant particles. In various embodiments, the coating over the insert 30 may have a thickness of ranging from about 1 μm to about 500 μm.

Sand mold and coring arrangement 40 comprises cope 42 and drag 44. The cavity defining surfaces of cope 42 and drag 44 may be substantially identical when two identical brake rotors 10 are being cast with one brake rotor being formed, as illustrated, in each of the cope 42 and drag 44.

Supported within and between cope 42 and drag 44 molds is a combination of two identical and facing rib cores (upper rib core 48 in FIG. 2 and lower rib core 50). Sandwiched between rib cores 48, 50 is a single annular splitter core 52. Each of the cores 48, 50, 52 may be a hardened sand core which could be coated with refractory or non-refractory type coating for better surface finish. Each of the cores 48, 50, 52 may be molded separately of resin bonded sand using suitable methods known in the art. In one embodiment, an annular sound damping insert 30 is then positioned between each of the rib cores 48, 50 and the annular splitter core 52. As described below, the rib cores 48, 50 are designed to receive the insert 30 and the plurality of radial tabs 32.

Each of the cores 48, 50, 52 is round and when the cores are assembled as illustrated in FIG. 2 their circumferential edges are substantially aligned. The three-core combination (rib cores 48, 50 and splitter core 52) and the inserts 30 may be assembled and held together with clips 54 or other suitable securing fasteners for easy assembly on drag 44 and enclosure by placement of cope 42 as illustrated in FIG. 2. In casting, molten metal may be introduced through a runner system in cope 42 and drag 44 molds and at suitable in-gate openings (not shown, for simplicity of illustration) at the parting faces of the cope 42 and drag 44 and into openings (not shown) in the outer edges of rib cores 48, 50 and/or splitter core 52.

Figure 5:
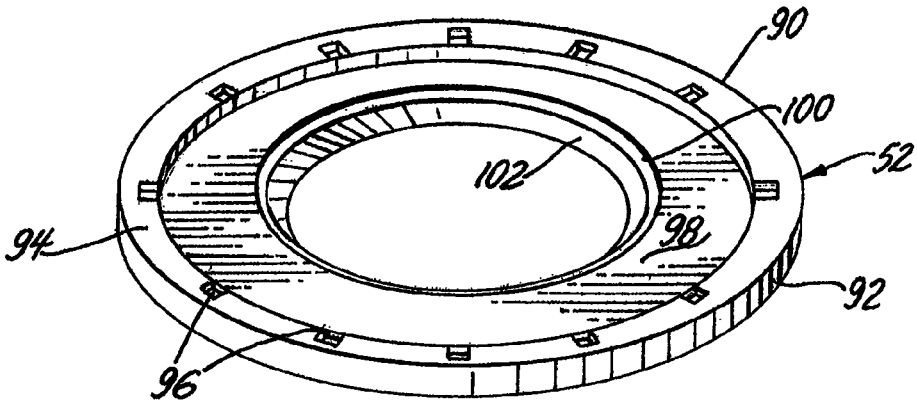
FIG. 5 is an oblique view of a splitter core for the core assembly illustrated in FIG. 2.
Figure 3:
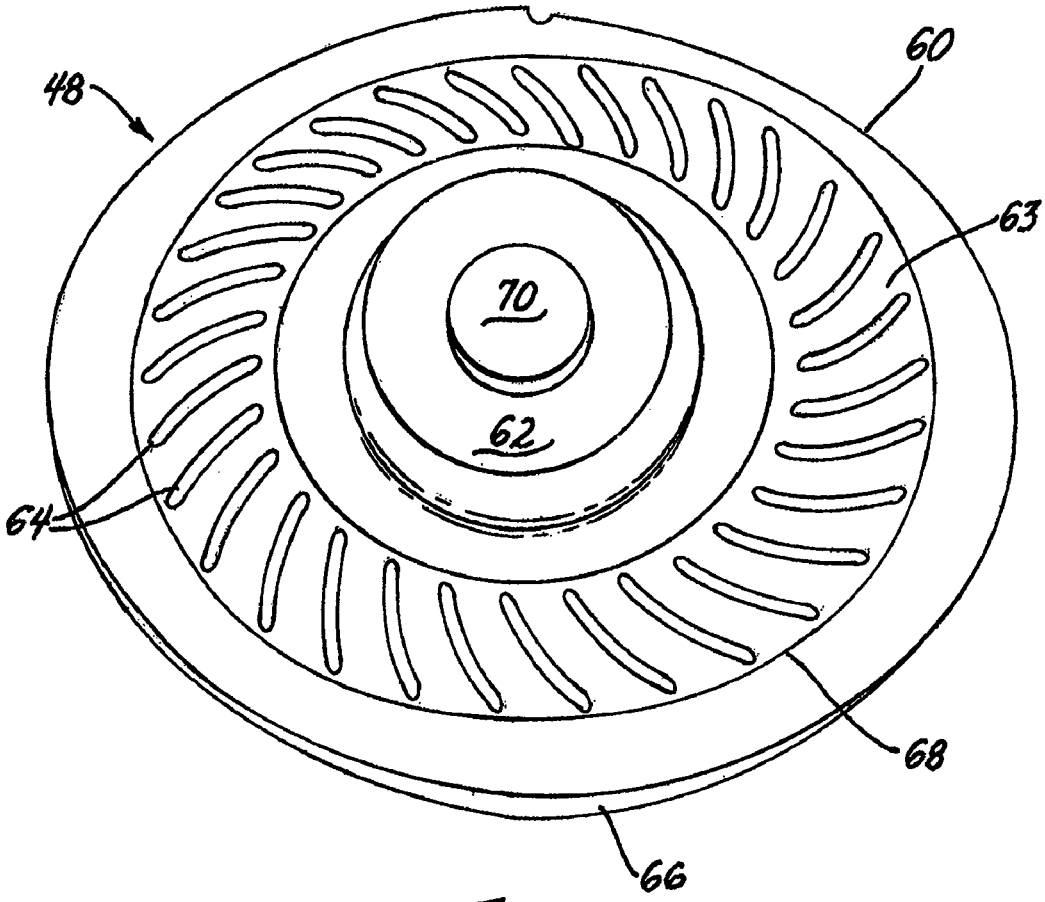
FIG. 3 is an oblique view of the top side of a rib core for a sand core assembly for casting a pair of rotors like the rotor illustrated in FIG. 1.
Figure 4:
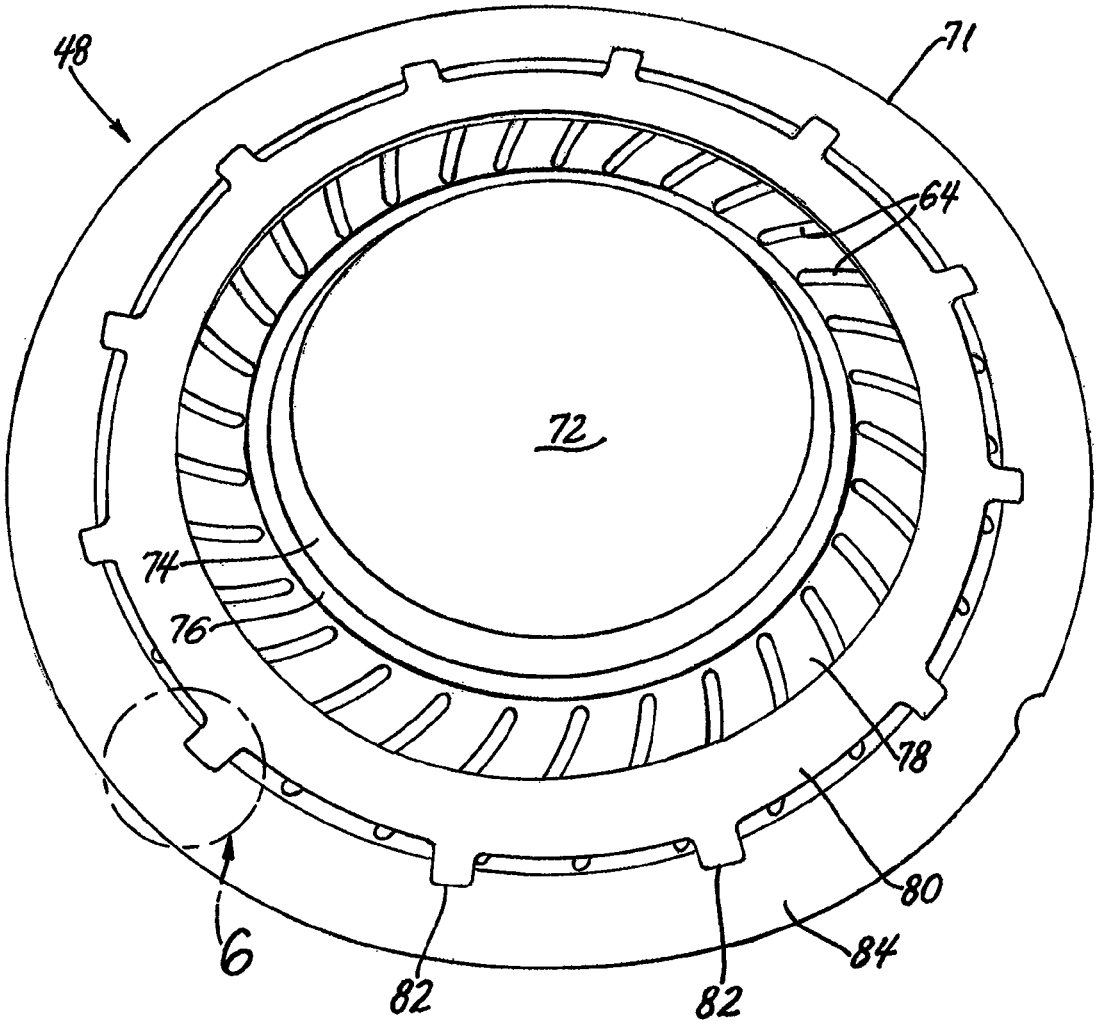
FIG. 4 is an oblique view of the bottom side of the rib core illustrated in FIG. 3.
Figure 6:
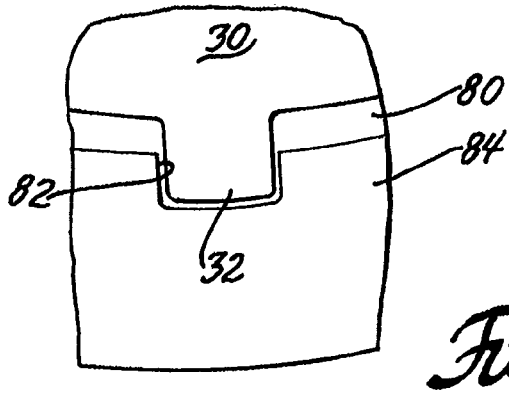
FIG. 6 is an enlarged view of a portion (circled and identified with a "6") of the bottom side of the rib core of FIG. 4.

Reference may also be made to FIG. 3 for a view of the top surface of rib core 48 and to FIG. 4 and FIG. 6 for a view of the bottom surface of rib core 48 as that core is placed in sand mold and coring arrangement 40 illustrated in FIG. 2. An oblique view of annular splitter core 52 is provided in FIG. 5.

As stated, rib cores 48, 50 have the same shape because they are being used to cast like brake rotors 10. Accordingly, a description of rib cores will be made with reference to rib core 48 as illustrated in FIGS. 2, 3, 4, and 6. Rib cores 48, 50, and splitter core 52 are suitably molded of resin bonded sand in shapes to facilitate the casting of a pair of brake rotors 10.

FIG. 3 illustrates the upper side 60 of rib core 48 as it is positioned in the sand mold and core assembly 40 of FIG. 2. When looking at an oblique view of the upper side 60 of rib core 48, as seen in FIG. 3, structural features of the rib core 48 for defining inboard surfaces of brake rotor 10 are illustrated from a different perspective than in the sectional view of FIG. 2.

Rib core 48 is round and its upper side 60 has a hub-shaping portion 62 for defining the inboard surfaces of radial hub surface 18 and axial hub surface 20 in the casting of brake rotor 10. Hub shaping portion 62 has a central portion 70 for defining the axial opening in brake rotor 10. Surface 63 of rib core 48 defines the inboard surface of outboard annular rotor body 22 and has holes 64 for forming radial vanes 26 in brake rotor 10. The peripheral edge 66 of rib core 48 lies against an inner surface of a cope 42 or drag 44 mold member. An inner circular edge 68 of rib core 48 cooperates with the respective mold member to define the round outer edge surface of outboard annular rotor body 22.

FIG. 4 illustrates the bottom side 71 of a rib core 48. The bottom side 71 of rib core 48 comprises a round central flat surface 72 for lying against a like surface of a like rib core (for example rib core 50 in FIG. 2). The bottom side of rib core 48 comprises a round tapered surface 74 for engaging an edge of splitter core 52, a surface 76 for engaging an inner circular edge of annular sound damping insert 30, a surface 78 for defining an inner surface of inboard annular rotor body 24, and holes 64 for vanes 26. The bottom side 71 of rib core 48 has a round surface 80 for receiving an annular sound damping insert (30 in FIGS. 1 and 2). In the embodiment of FIG. 4, surface 80 has twelve radial extensions 82 for receiving radially extending locating tabs (32 in FIGS. 1 and 2). Surface 84 of rib core is configured to lie against a like surface of a like rib core (for example rib core 50 in FIG. 2).

In-gates for the admission of molten metal (not shown) may be formed in surface 84 between radial extensions 82. When the sand mold and core arrangement 40 are in a horizontal position as illustrated in FIG. 2, such in-gates may for example be formed between every other radial extension. When the sand mold and core arrangement 40 are in a vertical position such in-gates may be formed in the lower region of the mold and core arrangement.

FIG. 6 illustrates an enlarged portion of FIG. 4 showing a portion of an annular sound damping insert 30 lying on rib core surface 80 with a tab 32 of the damping insert 30 lying on a slightly enlarged core surface 82. A suitable number of tabs 32 are used to support damping insert 30 on rib core 48 (and splitter core 52) during casting of brake rotors 10. Tabs 32 may extend beyond the intended outer peripheral surfaces of inboard annular body 24 and the tabs 32 may be removed by machining from the cast brake rotor as a finishing operation.

An oblique view of a surface 90 of splitter core 52 is presented as FIG. 5. In this embodiment of the disclosure, both surfaces of splitter core 52 are alike. As seen on FIG. 2, annular splitter core 52 is shaped to fit between a pair of rib cores (48 and 50 in FIG. 2). The outer circumferential surface 92 is shaped to align with the outer surfaces 66 of the sandwiching rib cores and to fit against interior surfaces of cope 42 and drag 44 mold members. Surface 94 of splitter core 52 lies against complementary surface 84 of an adjacent rib core 42. Radial indentations 96 are formed in surface 94 for receiving radial insert tabs 32 in an assembled sand mold and coring combination 40. Splitter core surface 98 is shaped to define inner surfaces of inboard annular body 24. Surface 100 supports an inner edge of annular sound damping insert 30 and surface 102 is shaped to engage a complementary surface on a facing rib core (core 48 in FIG. 2).

Thus, a pair of like rib cores 48, 50 and a complementary splitter core 52 are shaped to hold two annular sound damping inserts, like inserts 30 in FIG. 2. The cores 48, 50, 52 and inserts 30 are shaped and conveniently assembled as described above with respect to drawing FIGS. 2-6. The assembly is placed in complementary sand mold bodies for the casting of a pair of brake rotors having cooling vents and cast-in-place sound damping inserts.

In the above embodiment the core assembly was designed to hold a pair of sound damping inserts for casting into the inboard annular rotor bodies of two like brake rotors. But the core assembly may also be adapted for incorporating the insert in the outboard annular rotor body or in both inboard and outboard rotor bodies of the sand mold-cast, vented brake rotor shapes.

In another embodiment (not shown), more than two rib cores with inserts can be assembled having a splitter core to produce more than two sound damped rotors. For example, the cope 42 and drag 44 molds may be constructed and arranged to support two sets of facing rib cores 48, 50. A splitter core 52 is sandwiched between each set of facing rib cores 48, 50. In this manner, four sound damped rotors may be produced simultaneously. In other embodiments, the cope 42 and drag 44 molds may support any suitable number of sets of facing rib cores in a similar repeating arrangement.

Practices of the invention have been shown by examples that are presented as illustrations and not limitations of the invention.

The invention claimed is:

1. A method of casting a pair of like or identical brake rotors, each brake rotor including a central round hub with an axis of rotation and an integral radially extending annular rotor body, the hub extending axially with respect to the annular rotor body so that the brake rotor has a hub side and a rotor body side, and the annular rotor body of each brake rotor including an annular sound damping insert; the method comprising:

providing complementary sand mold bodies with like casting cavities for defining surfaces of the hub sides of the pair of brake rotors, the casting cavities to be in face-to-face relationship for casting of the pair of brake rotors;

providing at least two annular sound damping inserts, an annular splitter sand core and two like rib sand cores in an arrangement with one of the two like rib sand core on each side of the annular splitter sand core and with one of the two sound damping insert between each like rib sand core and the annular splitter sand core:

the annular splitter sand core having two opposite sides, the annular splitter sand core comprising like casting surfaces on each side for supporting an annular sound damping insert on each casting surface and for shaping surfaces of the rotor body side of each brake rotor;

the two like rib sand cores having front surfaces for defining surfaces of the rotor body side of each brake rotor, and back surfaces for engaging and enclosing the annular splitter sand core and for facing contact with each other;

placing the assembly of cores and inserts between the complementary sand mold bodies to form a mold and core combination; and thereafter casting molten metal in the mold and core combination to form a pair of brake rotors with sound damping inserts.

2. A method of casting a pair of like or identical vented brake rotors as set forth in claim 1 further comprising securing the annular splitter sand core member with the sound damping inserts and the two like rib sand cores with a clip.

3. A method of casting a pair of like or identical vented brake rotors as set forth in claim 1 further comprising coating the sound damping inserts with at least one of particles, flakes, or fibers before assembling the at least two annular sound damping inserts, the annular splitter sand core and the two like rib sand cores.

4. A method of casting a pair of like or identical brake rotors as set forth in claim 1 in which the front surfaces of the two like rib sand cores further define vanes for venting the rotor body.

5. A method of casting a pair of like or identical brake rotors as set forth in claim 1 in which the annular rotor body comprises a first rotor body portion and a second rotor body portion, each of the first and second rotor body portions having an outer face and an inner face, and in which the front surfaces of the two like rib sand cores define the inner face of the first rotor body portion of each brake rotor, and in which the back surfaces define the inner face of the second rotor body portion of each brake rotor.

6. A method as set forth in claim 1 wherein the annular splitter sand core is enclosed between the two like rib sand cores and the three cores are clipped together and placed in and between the complementary sand mold bodies.

7. A method as set forth in claim 1 wherein the annular sound damping insert is enclosed between each side of the annular splitter core and one of the two like rib sand core.

8. A method as set forth in claim 1 wherein the annular sound damping insert has a coating thereon comprising at least one of particles, flakes, or fibers.

9. A method as set forth in claim 1 wherein the annular sound damping insert comprises radially extending locating tabs.

10. A method as set forth in claim 1 wherein the two liKe rib sand cores further comprise surfaces for supporting a sound damping insert comprising radial extensions for receiving the radially extending locating tabs.

* * * * *